United States Patent [19]

Hoskinson

[11] 4,169,395

[45] Oct. 2, 1979

[54] SCREW REMOVING TOOL

[76] Inventor: James H. Hoskinson, 10118 Duck Creek Rd., Salem, Ohio 44460

[21] Appl. No.: 881,793

[22] Filed: Feb. 27, 1978

[51] Int. Cl.[2] ..... B25B 7/00; B25B 7/02

[52] U.S. Cl. ..... 81/5.1 R; 145/50 R; 81/421

[58] Field of Search ..... 81/5.1 R, 180 R, 419, 81/421, 422, 424; 145/50 R; 144/32

[56] References Cited

U.S. PATENT DOCUMENTS 1,299,631 4/1919 Spangler ..... 81/5.1 R 2,352,917 7/1944 Scott ..... 145/50 R X

*Primary Examiner*—James G. Smith

*Attorney, Agent, or Firm*—Webster B. Harpman

[57] ABSTRACT

A tool for removing jammed or frozen screws from work pieces in difficult to reach areas where the required pressure on the screwdriver cannot be easily applied. The tool has a pliers-like configuration with one of the jaws having a bifurcated bracket engaged on the work piece adjacent the screw to be removed. The other jaw rotatably mounts the screwdriver. A socket on the screwdriver is engagable by a socket wrench.

5 Claims, 3 Drawing Figures

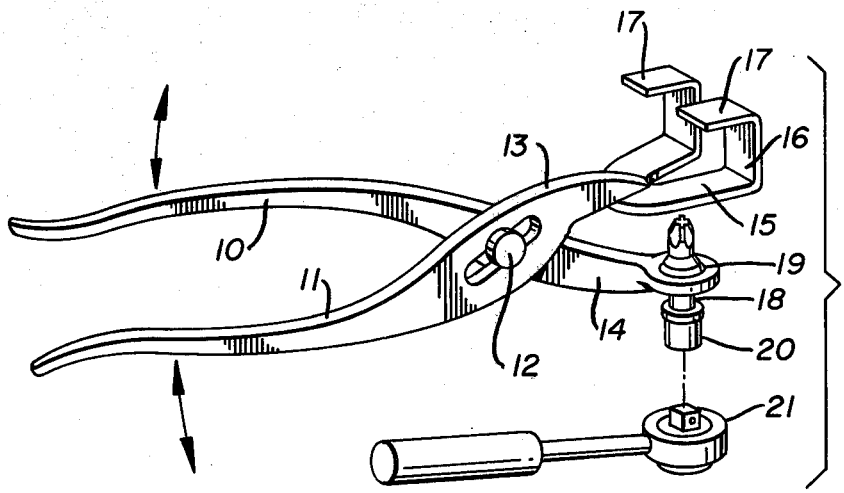
FIG. 1
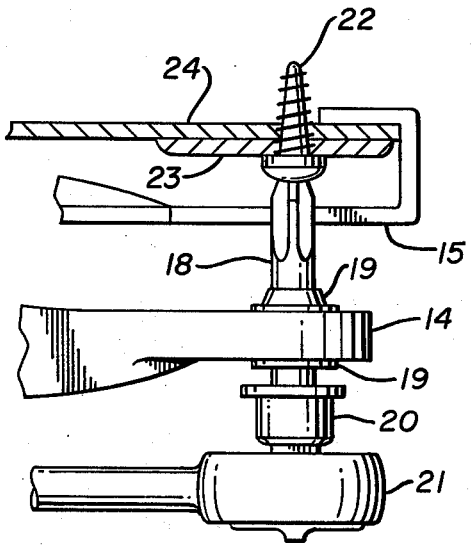
FIG. 3
FIG. 2
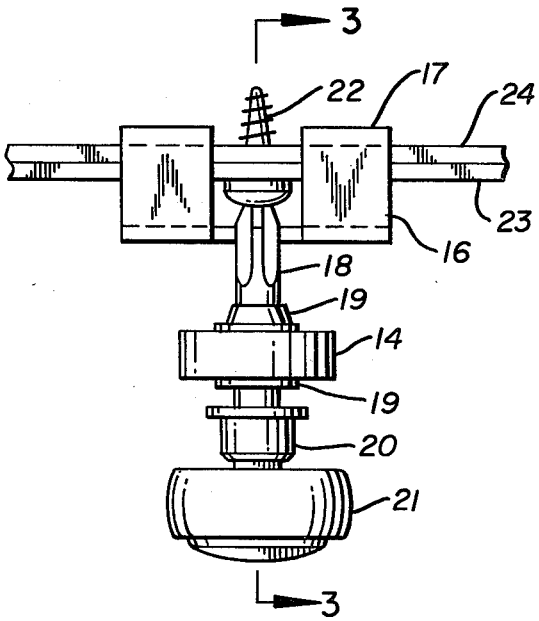

SCREW REMOVING TOOL

BACKGROUND OF THE INVENTION (1) Field of the Invention

This invention relates to screw removing tools of the lever actuated type.

(2) Description of the Prior Art

Prior structures of this type have utilized a varity of lever and fulcrum devices. See for example U.S. Pat. Nos. 2,352,917, 2,745,448, and 4,015,490.

In U.S. Pat. No. 2,352,917 a pliers-like tool has opposing jaws with a fixed screwdriver located in one of the jaws.

In the present invention the screwdriver is rotatable and the bracket fixes the jaws relative to the workpiece.

In both U.S. Pat. Nos. 2,745,448 and 4,015,490, the disclosed tools are attached to the workpieces by a bolt.

The present invention includes no such structure or function.

SUMMARY OF THE INVENTION

A screw removing tool having a pliers-like configuration and use wherein one of the opposing jaws has a bifurcated U-shaped bracket that engages the material holding the screw. The other jaw has a rotatably mounted screwdriver therein. A socket on the screwdriver is engaged by a socket wrench so that a screwdriver when forcibly engaged on the screw by the tool can rotate the screw and remove it.

DESCRIPTION OF THE DRAWINGS

FIG. 1 is a perspective view of the screw removing tool and socket wrench;

FIG. 2 is an end view of the screw removing tool with the socket wrench engaged; and FIG. 3 is a vertical section on line 3—3 of FIG. 2.

DESCRIPTION OF THE PREFERRED EMBODIMENT

Referring now to FIG. 1 of the drawings, a tool for removing jammed or frozen screws in difficult to reach areas comprises a pair of elongated handles 10 and 11 pivotally secured to one another by a pivot 12 forming a pliers-like tool having oppositely disposed jaws 13 and 14. The jaw 13 has a bifurcated member 15 extending outwardly therefrom. The ends of the bifurcated member 15 are turned upwardly and inwardly as at 16 and 17 to form a U-shaped bracket. The jaw 14 is apertured at its end to rotatably mount a screwdriver 18. Annular flanges 19 on the screwdriver 18 position the same in the apertured jaw 14.

As will be seen in FIGS. 2 and 3 of the drawings, a socket 20 is secured to one end of the screwdriver 18 for detachable engagement with a socket wrench 21.

In FIG. 3 of the drawings, it will be seen that a screw 22 secures a molding 23 to the inside edge of a workpiece 24, such as can be found on a wheel wall of an automobile. The screw 22 is engaged by the screwdriver 18 and held by the clamping action of the pliers-like tool. The socket wrench 21 is engaged in the socket 20 on the screwdriver 18.

In operation the screw removing tool is positioned to engage both the workpiece 24 and the frozen or jammed screw 22. Pressure is applied to the tool by the user's one hand, while the other hand is used to move the socket wrench 21 in the socket 20. The turning motion of the socket wrench 21 thus frees the screw 22.

The above-described structure provides relatively easy and fast removal of frozen or jammed screws with positive engagement of the screwdriver with the screw by the pliers-like action of the tool.

Although but one embodiment of the present invention has been illustrated and described, it will be apparent to those skilled in the art that various changes and modifications may be made therein without departing from the spirit of the invention and having thus described my invention what I claim is:

1. A device for removing a screw from a workpiece comprising a pliers-like tool having pivoted jaws of substantially equal length, an extension on one jaw, said extension comprising a U-shaped bracket, one portion of said U-shaped bracket extending axially from said one jaw, the other portion of said U-shaped bracket positioned in outwardly spaced relation with respect to said one portion so as to form an offset hook-like configuration that can be hooked over said workpiece on the opposite side thereof from said screw and a screwdriver rotatably mounted in an opening in the other jaw in oppositely disposed relation to said U-shaped bracket, means for rotatably securing said screwdriver in said opening, said screwdriver being engagable in said screw to be removed and a wrench for rotating said screwdriver.

2. The device for removing a screw from a workpiece set forth in claim 1 wherein the extension is bifurcated.

3. The device for removing a screw from a workpiece set forth in claim 1 wherein said means for rotatably securing said screwdriver are annular flanges on said screwdriver.

4. The device for removing a screw from a workpiece set forth in claim 2 wherein said bifurcated U-shaped bracket and the screwdriver are disposed on a common center line.

5. The device for removing a screw from a workpiece set forth in claim 2 wherein a socket is formed on said screwdriver and said wrench engages said socket.

* * * * *